US007273350B2

(12) United States Patent
Kopmels et al.

(10) Patent No.: US 7,273,350 B2
(45) Date of Patent: Sep. 25, 2007

(54) HEAT TRANSFER ARRANGEMENT

(75) Inventors: Michiel Kopmels, Bristol (GB); Keith C. Sadler, Bristol (GB)

(73) Assignee: Rolls-Royce, PLC, London (GB)

( * ) Notice: Subject to any disclaimer, the term of this patent is extended or adjusted under 35 U.S.C. 154(b) by 36 days.

(21) Appl. No.: 11/272,969

(22) Filed: Nov. 15, 2005

(65) Prior Publication Data

US 2006/0104814 A1 May 18, 2006

(30) Foreign Application Priority Data

Nov. 16, 2004 (GB) ..... 0425200.3

(51) Int. Cl.
*F03B 11/00* (2006.01)
*F01D 5/18* (2006.01)

(52) U.S. Cl. ..... 416/96 R; 415/115; 416/97 R

(58) Field of Classification Search ..... 415/115; 416/96 R, 97 R

See application file for complete search history.

(56) References Cited

U.S. PATENT DOCUMENTS 4,056,332 A 11/1977 Meloni
4,473,336 A * 9/1984 Coney et al. ..... 416/96 R
4,770,608 A * 9/1988 Anderson et al. ..... 416/97 R
5,263,820 A 11/1993 Tubbs
5,813,835 A * 9/1998 Corsmeier et al. ..... 416/97 R
6,206,638 B1 3/2001 Glynn et al.

FOREIGN PATENT DOCUMENTS

EP 0 392 664 A2 10/1990
EP 0 905 353 A1 3/1999
EP 1 496 203 A1 1/2005

* cited by examiner

*Primary Examiner*—Igor Kershteyn
(74) *Attorney, Agent, or Firm*—Oliff & Berridge, PLC

(57) ABSTRACT

A heat transfer arrangement comprises a target member (28 or 30), and an impingement member (32). The impingement member (32) defines a fluid path (38 or 40) there through to direct fluid onto the target member. The arrangement includes a fluid directing formation (42) on the impingement member (32). The fluid path (38 or 40) extends through the fluid directory formation (42) such that the fluid path directs fluid to exit there from at an exit angle that is substantially orthogonal to the fluid directing formation.

18 Claims, 8 Drawing Sheets

HEAT TRANSFER ARRANGEMENT

BACKGROUND

This invention relates to heat transfer arrangements. More particularly, but not exclusively, the invention relates to heat transfer arrangements for effective cooling by impingement.

In the high pressure turbine of a gas turbine engine, the components, particularly the nozzle guide vanes and the turbine blades, are subjected to high temperatures from the gases exiting from the combustor. The nozzle guide vanes and turbine blades thus require cooling to prevent a reduced life. Such cooling is generally effected by taking air from the high pressure compressor. Since such air does not pass through the combustor, it is not fully used to do work in the turbine and therefore has an adverse effect on engine efficiency. Therefore, this cooling air has to be used efficiently.

SUMMARY

According to one aspect of this invention, there is provided a heat transfer arrangement comprising a target member, an impingement member defining a fluid path to direct a heat transfer fluid onto the target member, wherein the arrangement includes a fluid directing formation on the impingement member, the fluid path extending through the fluid directing formation such that the fluid path directs fluid to exit there from at an exit angle that is substantially orthogonal to the fluid directing formation.

Preferably, the impingement and target members are generally non-parallel to each other. Preferably, the fluid directing formation extends outwardly from the impingement member. Preferably, the fluid path extends through the impingement member.

The fluid directing formation may have an outer surface having a region facing the target member, said region being generally orthogonal to the fluid path, such that fluid exits there from generally orthogonally to said region of said surface.

In one embodiment, the impingement member may define a plurality of fluid paths which may extend across each other. Preferably, the arrangement includes first and second fluid paths, which may extend across each other. Preferably, the plurality of said fluid paths intersect each other.

The plurality of fluid paths may define an intersection zone there between. Said intersection zone may be a zone through which said heat transfer fluid passes.

The impingement member may define a plurality of sets of said first and second fluid paths. Each set may extend through a respective fluid directing formation. The formation defining each set may define a respective zone.

Alternatively, each set of first and second fluid paths may extend through a common fluid directing formation.

In one embodiment, the intersection zone may have a geometry that is generally spherical in configuration. In another embodiment, the intersection zone may have a geometry that is generally cylindrical in configuration.

The arrangement may include a plurality of target members. Each target member may be associated with a respective one of the fluid paths, whereby fluid from the fluid path may impinge on the respective target member.

The fluid directing formation may extend from the impingement member. Conveniently the fluid directing formation extends beyond the impingement member towards the, or each, target member. Thus, the formation may have a thickness or diameter that is greater than the thickness of the impingement member.

The impingement member may be an impingement wall. The, or each, target member may be a target wall.

The heat transfer fluid may be a cooling fluid to cool the, or each, target member. The heat transfer arrangement may comprise a cooling arrangement.

According to another aspect of this invention there is provided an aerofoil incorporating a heat transfer arrangement described above.

In one embodiment the aerofoil may comprise a vane, such as a nozzle guide vane in a turbine. In another embodiment, the aerofoil may comprise a blade, such as a turbine blade.

According to another aspect of this invention there is provided a rotary component of an engine, said rotary component incorporating an aerofoil as described above. The engine may be a gas turbine engine.

In one embodiment, the rotary component may comprise a turbine such as a high pressure turbine.

According to another aspect of this invention there is provided an engine incorporating a rotary component as described above.

The engine may be a gas turbine engine.

BRIEF DESCRIPTION OF THE DRAWINGS

Embodiments of the invention will now be described by way of example only, with reference to the accompanying drawings, in which.

DETAILED DESCRIPTION OF THE EMBODIMENTS

Figure 1:
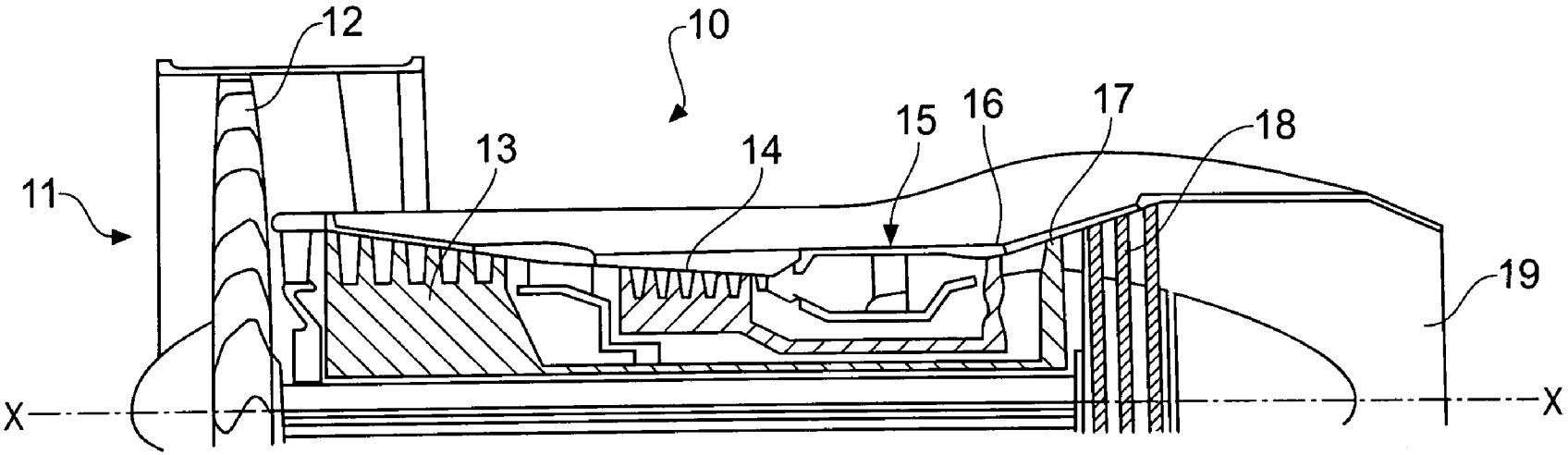
FIG. 1 is a sectional side view of the upper half of a gas turbine engine.

Referring to FIG. 1, a gas turbine engine is generally indicated at 10 and comprises, in axial flow series, an air intake 11, a propulsive fan 12, an intermediate pressure compressor 13, a high pressure compressor 14, a combustor 15, a high pressure turbine 16, an intermediate pressure turbine 17, a low pressure turbine 18 and an exhaust nozzle 19.

The gas turbine engine 10 works in a conventional manner so that air entering the intake 11 is accelerated by the fan 12 which produce two air flows: a first air flow into the intermediate pressure compressor 13 and a phase change air flow which provides propulsive thrust. The intermediate pressure compressor compresses the air flow directed into it before delivering that air to the high pressure compressor 14 where further compression takes place.

The compressed air exhausted from the high pressure compressor 14 is directed into the combustor 15 where it is mixed with fuel and the mixture combusted. The resultant hot combustion products then expand through, and thereby drive, the high, intermediate and low pressure turbines 16, 17 and 18 before being exhausted through the nozzle 19 to provide additional propulsive thrust. The high, intermediate and low pressure turbine 16, 17 and 18 respectively drive the high and intermediate pressure compressors 14 and 13, and the fan 12 by suitable interconnecting shafts.

Figure 2:
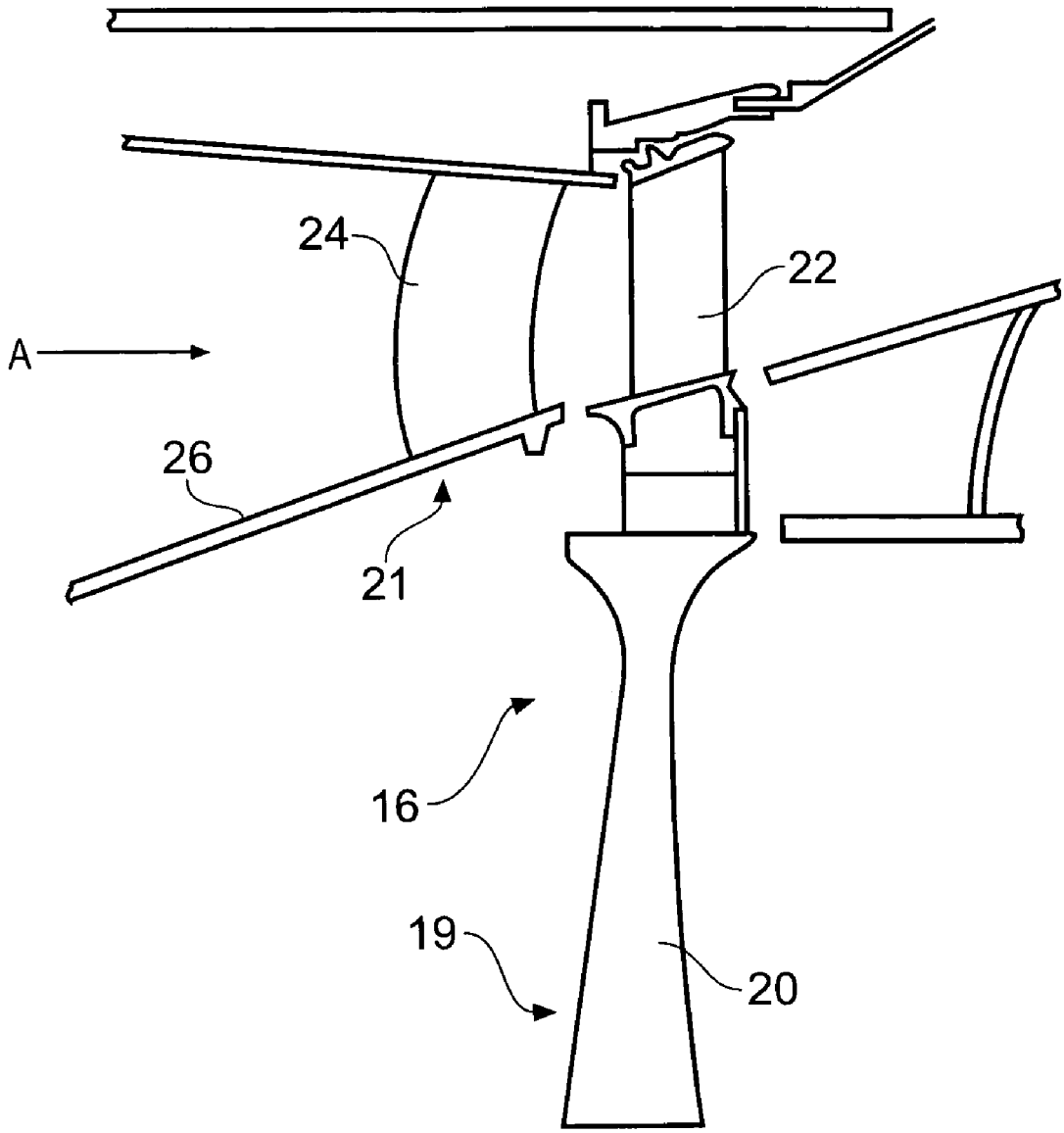
FIG. 2 is a sectional side view of a turbine for use in the gas turbine engine shown in FIG. 1.

Referring to FIG. 2 there is shown in more detail an upper region of the high pressure turbine 16 of the engine 10 shown in FIG. 1. The high pressure turbine 16 comprises a rotary part 19 and a stationary part 21. The rotary part 19 comprises a disc 20 upon which a plurality of turbine blades 22 are mounted. The blades 22 are mounted one after the other circumferentially around the disc and each blade 22 extends radially outwardly from the disc 20. The stationary part 21 comprises a plurality of nozzle guide vanes 24 arranged one after the other circumferentially around an inner casing 26. Air passes in the direction shown by the arrow A from the combustion equipment 15 onto nozzle guide vanes 24 from which the air is directed onto the turbine blades 22, causing the rotary part 19 of the turbine 16 to rotate.

The gas exiting the combustor 15 is at a very high temperature, for example 2100K. Such high temperatures can reduce the life of the nozzle guide vanes 24 and the turbine blades 22. As a result cooling is required in the nozzle guide vanes 24 and on the turbine blades 22 to increase the life of these components.

Figure 3:
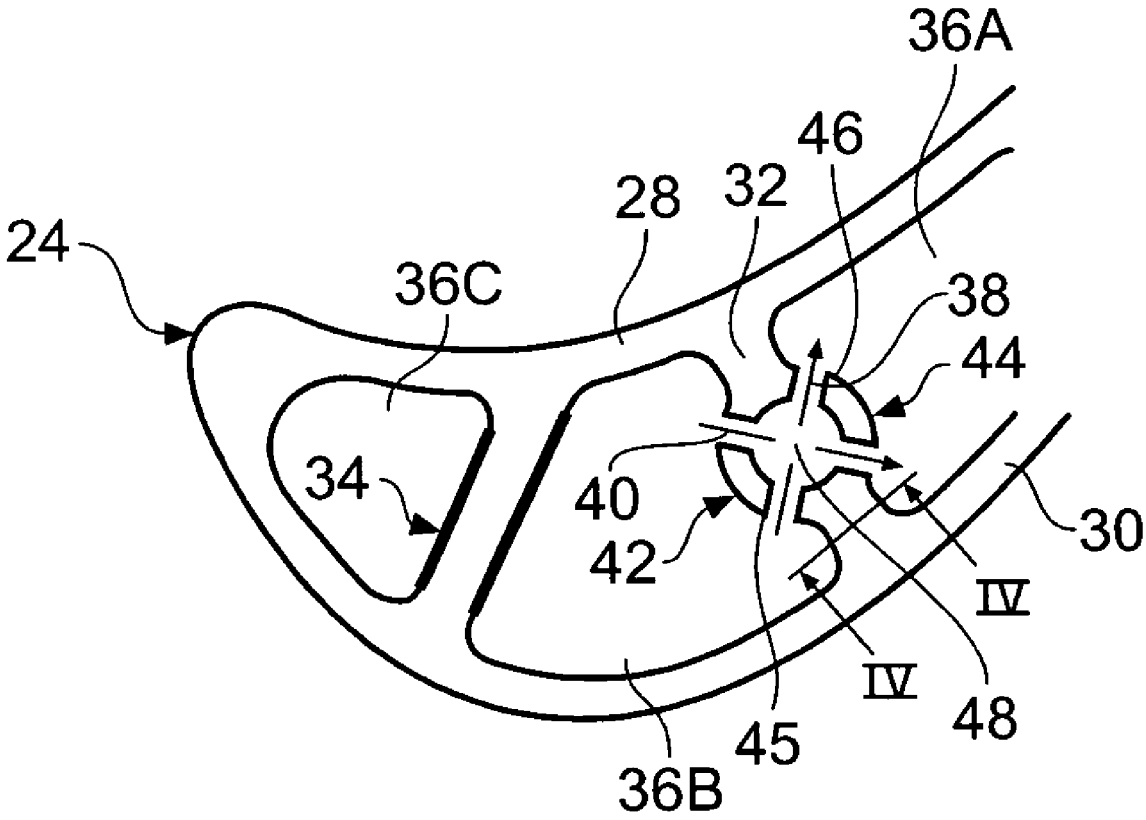
FIG. 3 is a cross-sectional plan view of the leading edge region of a high pressure turbine blade used in the turbine shown in FIG. 2.

Referring to FIG. 3 there is shown a cross-sectional plan view of the leading edge region of one of the blades 22. As can be seen the blade 22 comprises first and second outer walls 28, 30 and first and second inner walls 32, 34 extending between the outer walls 28, 30. The blade 22 may include other walls, but these are not shown in FIG. 3 for clarity.

The first and second inner walls 32, 34 divide the inside of the blade 22 into a first, second and third internal regions 36A, 36B 36C.

In FIG. 3, it is desired to cool the first and second outer walls 28, 30 at the first internal region 36A. Cooling air is supplied in a conventional manner from the high pressure compressor 14, by-passing the combustor 15, to the second internal region 36B.

The first inner wall 32, defines first and second fluid paths 38, 40 to direct the cooling air from the second internal region 36B onto the inner surfaces respectively of the first and second outer walls 28, 30, to cool the first and second outer walls 28, 30 by impingement cooling as the air impinges onto the inner surfaces of the first and second outer walls 28, 30.

Since the cooling of the first and second outer walls 28, 30 is by impingement cooling, the first inner wall 32 can be referred to as impingement wall and the first and second outer walls can be referred to as target walls.

A fluid directing formation 42 is provided on the first inner wall 32. The fluid directing formation 42 has a first outwardly extending portion 44, which extends outwardly from the first inner wall 32 into the first region 36B towards the first and second outer walls 28, 30, and a second outwardly extending portion 45 extending into the second internal region 36B. The first outwardly extending portion 44 is convexly curved towards the first and second outer walls 28, 30 and has an outer surface 46 which may be of a cylindrical or spherical configuration (see FIGS. 4A and 4B). The first and second fluid paths 38, 40 terminate at the outer surface 46 of the outwardly extending portion 44, generally orthogonally thereto. Thus, as would be appreciated by the skilled person, cooling air exits from the first and second fluid paths 38, 40 generally orthogonally to the outer surface 46 of the outwardly extending portion 44 of the fluid directing formation 42.

The first and second fluid paths 38, 40 intersect each other at an intersection zone 48. The intersection zone 48 can be of a cylindrical configuration, as shown in FIG. 4A or of spherical configuration, as shown in FIG. 4B.

Figure 4A:
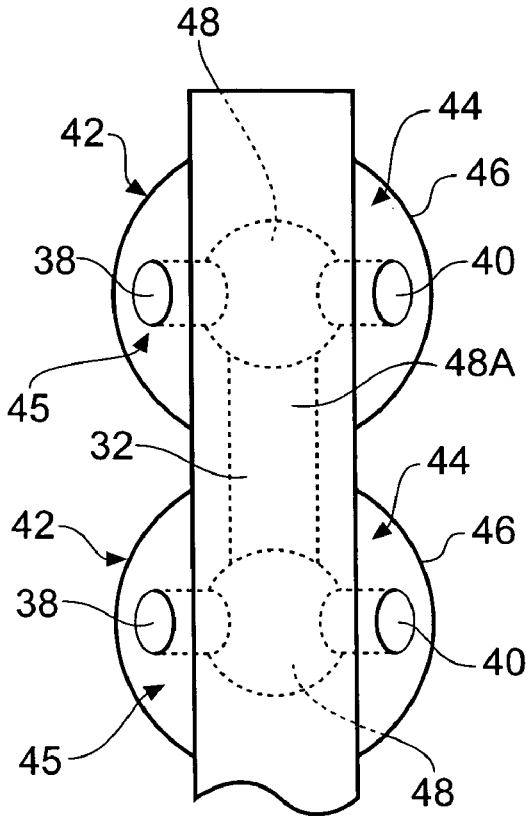
FIG. 4A is a view along the line IV-IV in FIG. 3 of one embodiment.
Figure 4B:
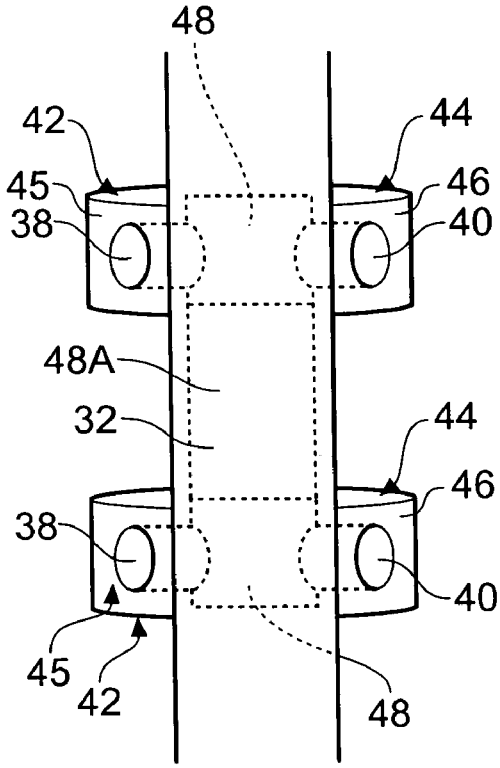
FIG. 4B is a view along the line IV-IV in FIG. 3 of another embodiment.

Referring particularly to FIGS. 4A and 4B, FIG. 4A shows an embodiment, in which the fluid directing formation 42 is of a spherical configuration. In this embodiment, the intersection zone 48 (shown in broken lines) is also of a spherical configuration. In FIG. 4A, there are two fluid directing formations 42 each defining a respective intersection zone 48. The two intersection zones 48 can be fluidly connected to each other by a third conduit 48A.

Figure 4C:
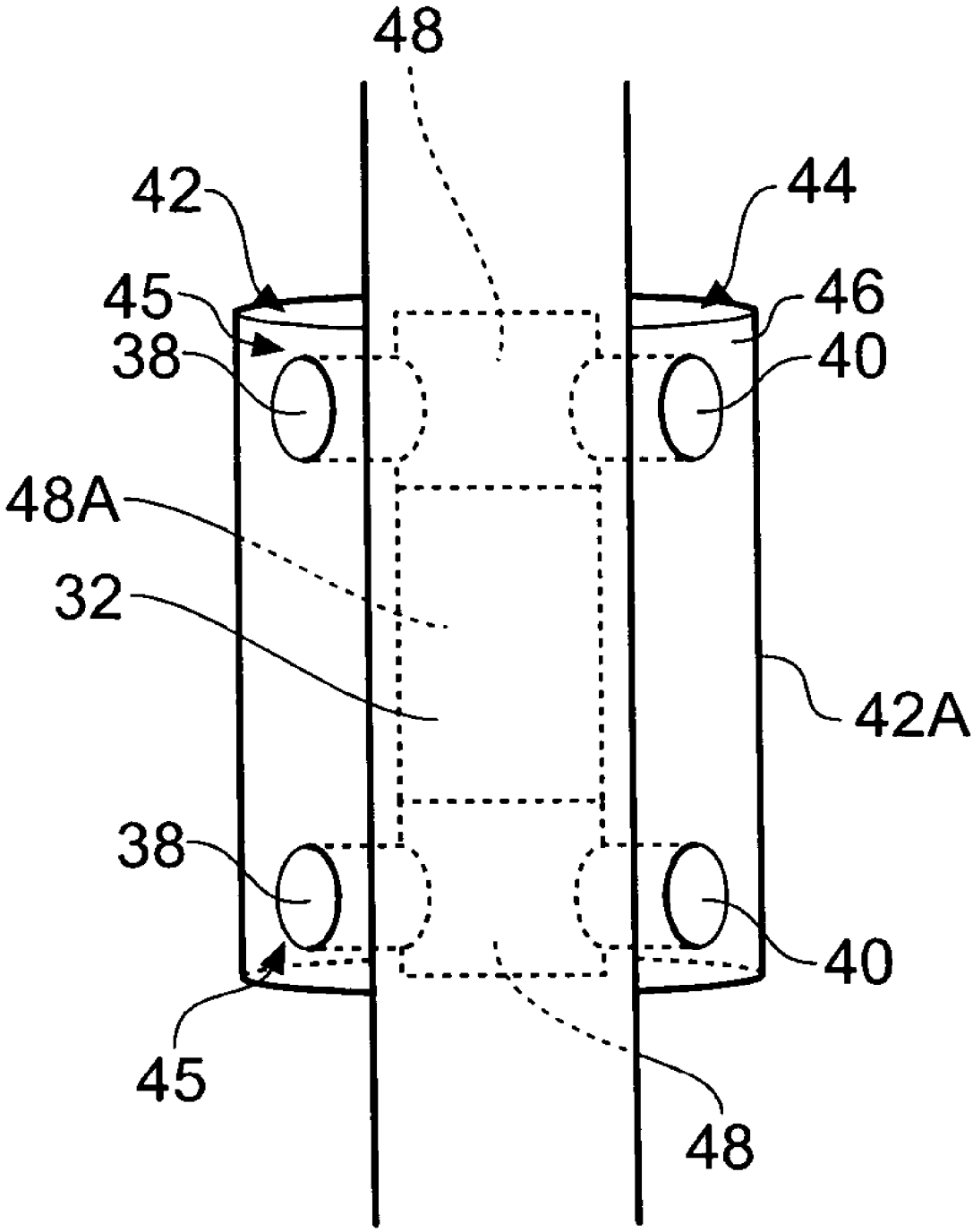
FIG. 4C is a view along the line IV-IV in FIG. 3 of another embodiment.

FIG. 4B shows another embodiment, in which the fluid directing formation 42 is of a generally cylindrical configuration. In this embodiment, two fluid directing formations 42 are provided, each defining a respective intersection zone 48 (shown in broken lines), which is of a cylindrical configuration. It will be appreciated that the two cylindrical fluid directing formations can be joined into a formation of a longer cylindrical configuration, as shown in FIG. 4C. The elongate fluid directing formation in FIG. 4C is designated 42A. The embodiment shown in FIG. 4C has many of the same features as shown in FIG. 4B and these have been designated with the same reference numeral. In addition, the embodiment shown in FIG. 4C includes a fluid conduit 48A (shown in broken lines) by which fluid can pass between the two intersection zones 48. A fluid conduit 48 can also be provided in the embodiment shown in FIG. 4B to fluidly connect the two intersection zones 48.

It will be appreciated that a spherical fluid directing formation could define an intersection zone which is of a spherical configuration.

Thus, in the preferred embodiments described above, air is directed from an impingement wall, in the form of the first inner wall 32, onto first and/or second target walls, in the form of the first and second outer walls 28, 30, to cool the first and second outer walls, 28, 30 by impingement cooling. The fluid paths 38, 40 direct the cooling air generally orthogonally from the fluid directing formation 42 onto the first and second outer walls 28, 30, thereby providing improved cooling over prior art impingement walls which do not have a fluid directing formation and thereby direct cooling air at a non-orthogonal angle to the impingement wall onto the target wall. The preferred embodiments described above also have the advantage that the fluid directing formation 42 disposes the exits to the fluid paths 38, 40 closer to the first and second outer walls 28, 30 than would be the case if the first inner wall 32 did not have the fluid directing formation 42. This also improves cooling.

Various modifications can be made without departing from the scope of the invention for example the, or each, target wall and the impingement wall can be part of any other arrangement where cooling is desired. Also, although the preferred embodiments have been described as possessing a first and a second cooling path extending through the first inner wall 32, it will be appreciated that these could be a plurality of first and second cooling paths provided at different positions through the first inner wall 32. Also there may be only one fluid path through the impingement wall in the event that there is only one target wall, which requires cooling.

Figure 5A:
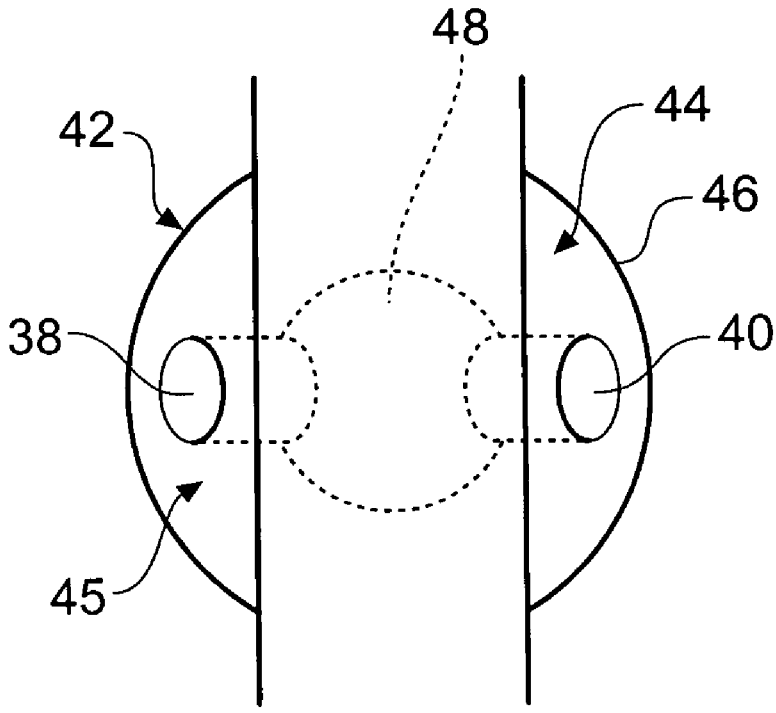
Figure 5B:
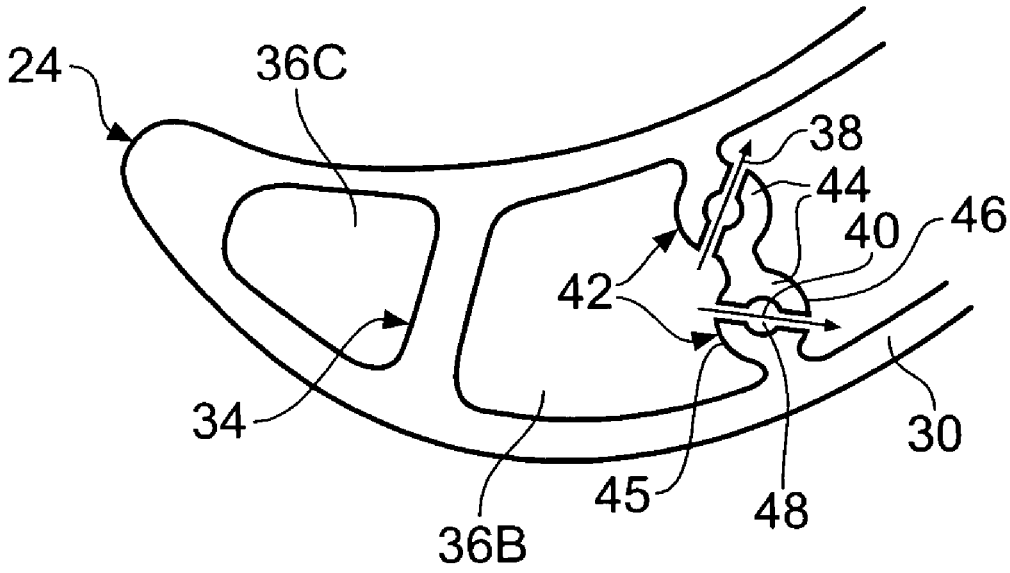
Figure 5C:
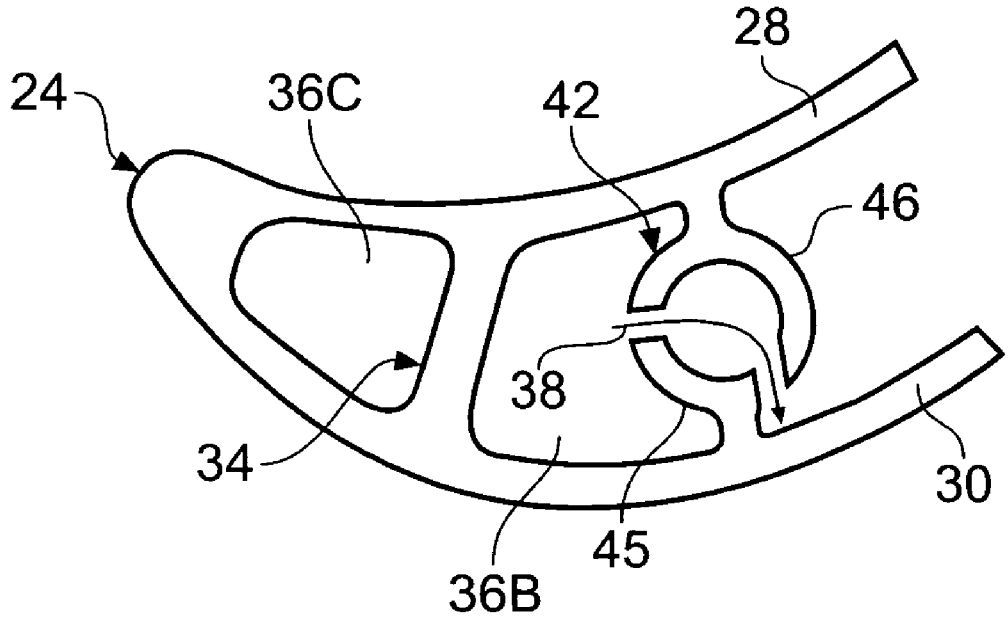
Figure 5D:
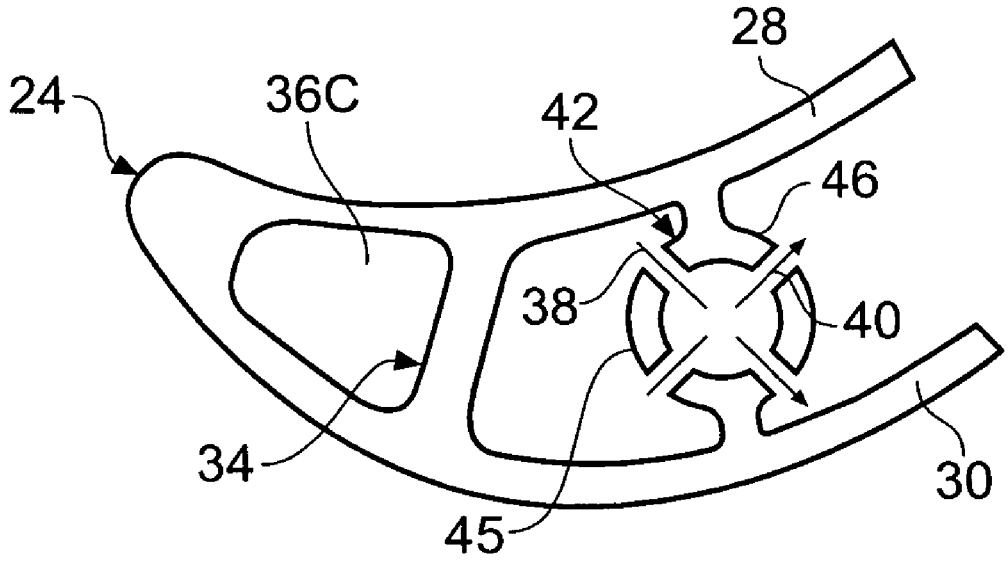
Figure 5E:
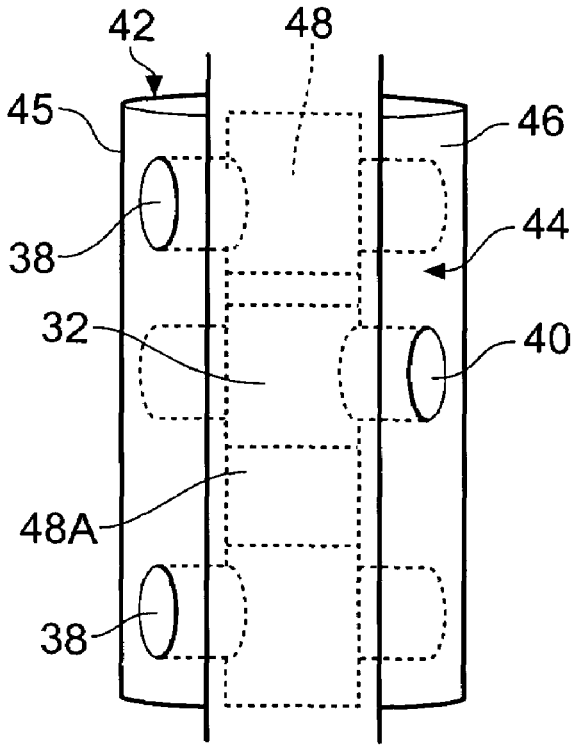
Figure 5F:
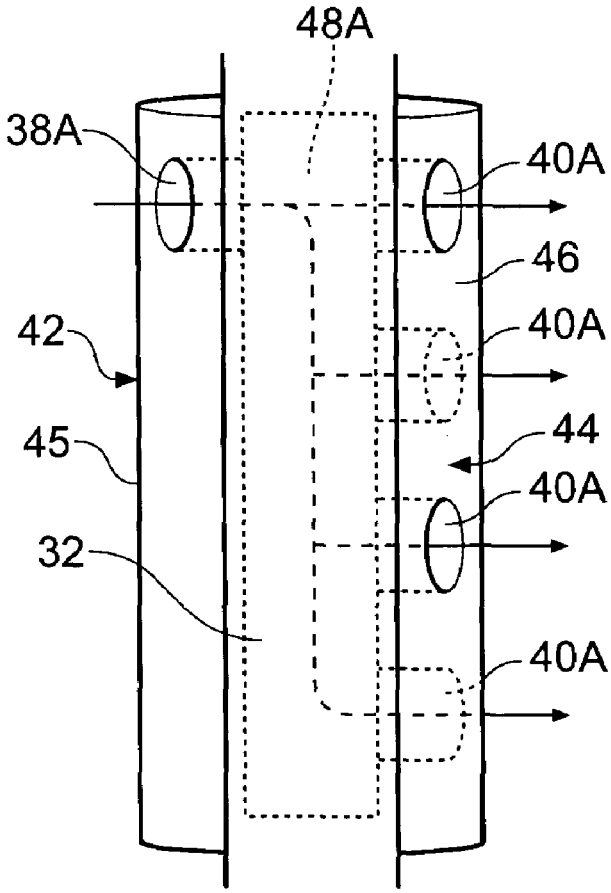

Other modifications, which do not depart from the scope of the invention, include: elliptical outwardly extending portions (FIG. 5A); a pair of fluid directing formations provided side by side on the impingement member (FIG. 5B), where each formation includes a path to direct fluid in a different direction to the path in the other formation; a fluid directing formation having a fluid path which directs fluid generally parallel to the impingement member (FIG. 5C) to cool one of the walls 30; fluid paths having different diameters (FIG. 5D), the fluid path 38 having a larger diameter than the fluid path 40, non-intersectory fluid paths (FIG. 5E), in which the fluid path, 38, 40 are arranged one above the other in FIG. 5E, fluid paths, with a single inlet 38A leading to a plurality of outlets 38, 40A via a fluid conduit 48A.

Whilst endeavoring in the foregoing specification to draw attention to those features of the invention believed to be of particular importance it should be understood that the Applicant claims protection in respect of any patentable feature or combination of features hereinbefore referred to and/or shown in the drawings whether or not particular emphasis has been placed thereon.

The invention claimed is:

1. A heat transfer arrangement, comprising:

a target member, and an impingement member defining a plurality of fluid paths extending across each other to direct a heat transfer fluid onto the target member, wherein the arrangement includes a fluid directing formation on the impingement member, the fluid path extending through the fluid directing formation such that the fluid path directs fluid to exit there from at an exit angle that is substantially orthogonal to the fluid directing formation.

2. A heat transfer arrangement according to claim 1 wherein the impingement and target members are non-parallel to each other.

3. A heat transfer arrangement according to claim 1 wherein the fluid directory formation extends outwardly from the impingement member.

4. A heat transfer arrangement according to claim 3 wherein the part of the fluid directing formation extending outwardly from the impingement member is hemispherical or hemicylindrical.

5. A heat transfer arrangement according to claim 1 wherein the fluid directing formation has an outer surface having a region facing the target member; said region being generally orthogonal to the fluid path, such that fluid exits there from generally orthogonally to said region of said surface.

6. A heat transfer arrangement according to claim 1 wherein the plurality of fluid paths comprises a set of first and second fluid paths, which extend across each other.

7. A heat transfer arrangement according to claim 6 wherein the impingement member defines a plurality of sets of said first and second fluid paths.

8. A heat transfer arrangement according to claim 6 wherein the set extends through a respective fluid directing formation.

9. A heat transfer arrangement according to claim 7 wherein each set of first and second fluid paths extends through a common fluid directing formation.

10. A heat transfer arrangement according to claim 8 defining a fluid conduit extending between the sets of first and second fluid paths to allow fluid flow therebetween.

11. A heat transfer arrangement according to claim 6 wherein the fluid paths of the set define a respective intersection zone therebetween, said intersection zone being a zone through which said heat transfer fluid passes.

12. A heat transfer arrangement according to claim 11 wherein the intersection zone has a geometry that is generally spherical in configuration.

13. A heat transfer arrangement according to claim 11 wherein the intersection zone has a geometry that is generally cylindrical in configuration.

14. A heat transfer arrangement according claim 1 wherein the arrangement includes a plurality of target members, each target member being associated with a respective one of the fluid paths, whereby fluid from each fluid path impinges on the respective target member.

15. A heat transfer arrangement according to claim 1 wherein the impingement member comprises and impingement wall.

16. A heat transfer arrangement according to claim 1 wherein the heat transfer fluid comprises a cooling fluid to cool the, or each, target member, whereby the heat transfer arrangement comprises a cooling arrangement.

17. An aerofoil incorporating a heat transfer arrangement as claimed in claim 1.

18. A turbine aerofoil incorporating a heat transfer arrangement as claimed in claim 1.

* * * * *